US009919185B1

(12) United States Patent
Qiubo

(10) Patent No.: US 9,919,185 B1
(45) Date of Patent: Mar. 20, 2018

(54) EXERCISE CHAIRS

(71) Applicant: Wang Qiubo, Zhejiang (CN)

(72) Inventor: Wang Qiubo, Zhejiang (CN)

( * ) Notice: Subject to any disclaimer, the term of this patent is extended or adjusted under 35 U.S.C. 154(b) by 0 days.

(21) Appl. No.: 15/396,762

(22) Filed: Jan. 2, 2017

(51) Int. Cl.

| | |
|---|---|
| ***A63B 71/00*** | (2006.01) |
| ***A63B 24/00*** | (2006.01) |
| ***A63B 21/00*** | (2006.01) |
| ***A63B 71/06*** | (2006.01) |
| ***A47C 7/00*** | (2006.01) |
| ***A47C 1/00*** | (2006.01) |
| ***A47C 7/14*** | (2006.01) |
| ***A47C 3/20*** | (2006.01) |

(52) U.S. Cl.
CPC ..... *A63B 24/0062* (2013.01); *A47C 1/00* (2013.01); *A47C 3/20* (2013.01); *A47C 7/002* (2013.01); *A47C 7/006* (2013.01); *A47C 7/14* (2013.01); *A63B 21/4027* (2015.10); *A63B 71/0622* (2013.01); *A63B 2071/0625* (2013.01); *A63B 2220/56* (2013.01); *A63B 2220/833* (2013.01); *A63B 2225/50* (2013.01)

(58) Field of Classification Search
CPC ..... A63B 2210/02; A63B 21/1609; A63B 41/00–41/10; A63B 5/16; A63B 24/0062; A63B 21/4027; A63B 71/0622; A63B 26/003; A63B 2225/62; A63B 2220/833; A63B 2071/0625; A63B 2220/56; A63B 2225/50; A47C 9/002–9/005; A47C 7/14; A47C 3/20; A47C 7/006; A47C 7/002; A47C 1/00; A61B 5/103; A61B 5/11; A61B 5/1116; A61B 5/1118; A61B 5/1123; A61B 5/1126
USPC ..... 297/217.2, 452.41
See application file for complete search history.

(56) References Cited

U.S. PATENT DOCUMENTS

| | | | | |
|---|---|---|---|---|
| 5,690,389 | A * | 11/1997 | Ekman | A47C 3/16 248/599 |
| 6,070,943 | A * | 6/2000 | Guery-Strahm | A47C 3/16 297/440.1 |
| 6,334,837 | B1 * | 1/2002 | Hein | A47C 15/004 482/8 |
| 6,461,284 | B1 * | 10/2002 | Francavilla | A61H 1/0218 482/121 |
| 6,832,817 | B1 * | 12/2004 | Chiu | A47C 4/54 16/43 |
| 8,056,976 | B1 * | 11/2011 | Polk | A47C 3/029 297/258.1 |
| D669,280 | S * | 10/2012 | Andersson | D6/379 |
| 9,408,469 | B1 * | 8/2016 | Chiu | A47C 4/02 |

(Continued)

*Primary Examiner* — Gregory Winter

(57) ABSTRACT

An exercise chair is disclosed that includes a backrest, four legs, and a ball frame, which is configured to nestably receive an inflated ball, such that a top surface of the inflated ball may receive a sitting person. The chair includes a pressure sensor that is positioned beneath a bottom surface of the inflated ball, which is configured to detect pressure exerted by the inflated ball and calculate force measurements resulting from such pressure. The chair also includes an electronic controller/transmitter that is configured to receive the force measurements from the pressure sensor; calculate whether a person sitting on the chair jumped from the chair based on such force measurements during a defined period of time; and communicate a total number of calculated jumps by the person over a defined period of time to the person.

16 Claims, 3 Drawing Sheets

(56) References Cited

U.S. PATENT DOCUMENTS

| | | | | |
|---|---|---|---|---|
| 9,415,276 | B1 * | 8/2016 | Hao | A63B 41/00 |
| 9,655,455 | B2 * | 5/2017 | Barnett | A47C 4/54 |
| 2008/0242521 | A1 * | 10/2008 | Einav | A61B 5/103<br>482/110 |
| 2011/0269601 | A1 * | 11/2011 | Nelson | A47C 7/021<br>482/8 |
| 2012/0299357 | A1 * | 11/2012 | Newman | A47C 4/54<br>297/452.41 |

* cited by examiner

EXERCISE CHAIRS

FIELD OF THE INVENTION

The present invention relates generally to the field of exercise chairs and related systems. More particularly, the field of the present invention relates to sitting chairs, which can be used to exercise while sitting (and to monitor, record, and communicate an amount of exercise activity to a user of such chairs).

BACKGROUND OF THE INVENTION

It has recently been shown that prolonged inactivity, and particularly prolonged inactivity associated with sitting, can have adverse health effects. Indeed, prolonged sitting has been shown to cause abnormalities in a person's blood circulation, which (over time) may cause deleterious health effects. The medical community has recently advised that office workers should move from a sitting position—and engage in some level of physical activity—at least once per hour. In recent years, a number of interactive sitting chairs have been developed and commercialized. However, the vast majority of such chairs, many of which are designed to provide some type of massage to a person, do not offer a suitable and effective means for encouraging and facilitating physical activity by persons sitting in such chairs. Accordingly, a need exists for improved interactive sitting chairs, which are designed to encourage and enable users of such chairs to periodically engage in meaningful physical activity—and thereby avoid the deleterious health effects that can otherwise be caused by prolonged periods of dormant sitting in such chairs.

As the following will demonstrate, many of such needs are addressed by the exercise chairs and related systems of the present invention.

SUMMARY OF THE INVENTION

According to certain aspects of the invention, an exercise chair is provided that is configured to accommodate a person sitting, and to be used by such person to perform certain physical activity (e.g., periodic jumps or hops from the chair). Still further, the exercise chair of the present invention is configured to monitor the amount of physical activity of a person (e.g., a number of jumps executed by the person sitting in the chair) over a defined period of time, and communicate such amount to the person as described herein. In certain embodiments, the exercise chair includes an interconnected backrest, four legs, and a ball frame, with the ball frame being configured to nestably receive an inflated ball. The invention provides that a top surface of the inflated ball is configured to receive a sitting person (i.e., it serves as the sitting platform of the chair). The chair also includes a pressure sensor that is positioned beneath a bottom surface of the inflated ball, which is configured to detect pressure exerted by the inflated ball and calculate force measurements resulting from such pressure. The chair also includes an electronic controller that is configured to receive the force measurements from the pressure sensor; calculate whether a person sitting on the chair jumped from the chair based on such force measurements during a defined period of time; and communicate a total number of calculated jumps by the person over a defined period of time to the person (e.g., through an operably connected LED display within the chair or through an external smart device that communicates wirelessly with the chair).

According to certain related aspects of the invention, exercise systems are provided, which generally include (1) the exercise chair mentioned above; (2) a smart device; and (3) a software application housed within the smart device. As described further below, the exercise systems are configured to monitor the amount of physical activity of a person (e.g., a number of jumps executed by a person sitting in the exercise chair) over a defined period of time, and communicate such amount to the smart device. The smart device, using the software application housed therein, may then report such physical activity measurements to the person—and conduct additional calculations based on such measurements and report the results of such calculations to the person (e.g., a non-limiting example of such additional calculations may be the total number of calories burned by the person using the chair).

The above-mentioned and additional features of the present invention are further illustrated in the Detailed Description contained herein.

DETAILED DESCRIPTION OF THE INVENTION

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Figure 1:
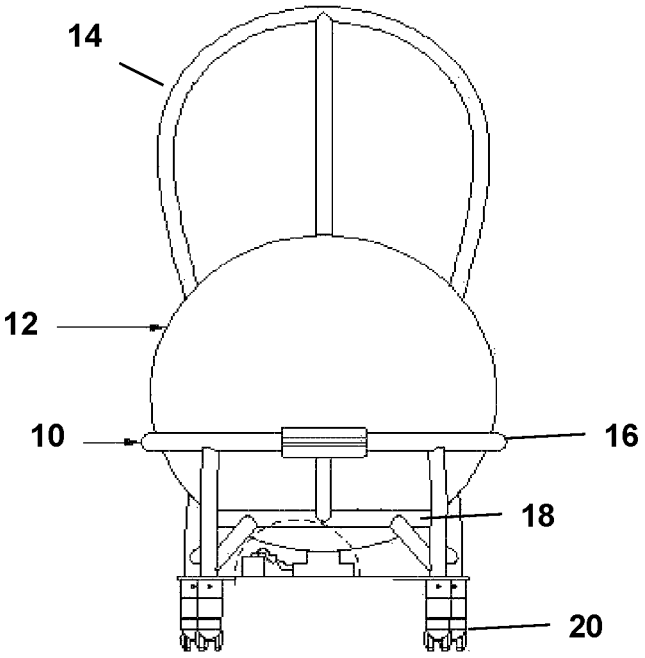
FIG. 1: A front side view of the exercise chair of the present invention.
Figure 2:
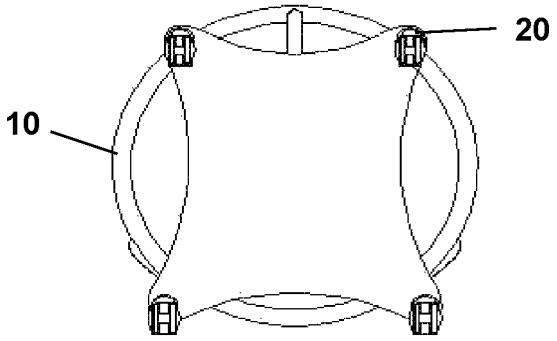
FIG. 2: A bottom side view of the exercise chair of the present invention.

According to certain preferred embodiments of the present invention, an exercise chair is provided that is configured to accommodate a person sitting and, periodically, engaging in physical activity or exercise using the chair. Still further, the exercise chair is configured to monitor the amount of physical activity a person sitting in the chair performs over a defined period of time, and communicate such amount to the person as described further below. Referring now to FIGS. 1-5, according to certain preferred embodiments, the exercise chair of the present invention comprises a rigid frame. The rigid frame includes a ball frame 10 that is configured to receive an inflated ball 12. The inflated ball 12 includes a port through which air may be injected into the inflated ball 12 (to inflate and pressurize the inflated ball 12). The inflated ball 12 is preferably pressurized to a point that the inflated ball 12 may be securely and nestably inserted into the ball frame 10, and to a point that the inflated ball 12 will support a person sitting on the inflated ball 12. As shown in FIG. 1, the inflated ball 12 serves as the base of the exercise chair on which a person sits—and on which a person may engage in physical activity, namely, jumping or bouncing up-and-down on the inflated ball 12.

The rigid frame preferably includes a backrest 14, which is configured to receive a person's back when the person is sitting idle within the exercise chair, e.g., when the person is not exercising and is using the chair to rest, perform office activities, etc. In certain preferred embodiments, the invention provides that the ball frame 10 includes two components, namely, a first frame component 16 and a second frame component 18. In such embodiments, both the first frame component 16 and second frame component 18 exhibit a circular configuration. The first frame component 16 is preferably larger in diameter than the second frame component 18. In such embodiments, the dimensions (diameter) of the first frame component 16 will be sufficient to securely hold the inflated ball 12 (when fully inflated) at, or just below, the mid-way point of the inflated ball 12 (i.e., at, or just below, where the circumference of the inflated ball 12 is greatest). The invention provides that the second frame component 18, due to its smaller diameter relative to the first frame component 16, is configured to securely hold and support the inflated ball 12 (when fully inflated) near a bottom area of the ball 12. The invention provides that the first frame component 16 and second frame component 18, together, are configured to securely hold the inflated ball 12, and support a person sitting and exercising on the inflated ball 12.

Figure 5:
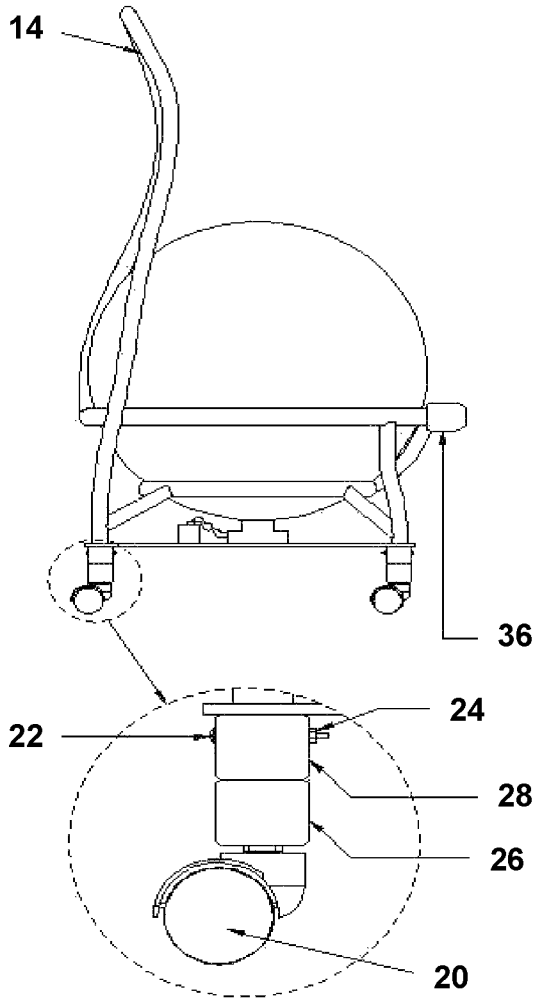
FIG. 5: A side view of the exercise chair of the present invention, showing an exploded view of the caster wheel and joint locks described herein.

Referring now to FIG. 5, according to certain preferred embodiments, the exercise chair preferably includes a set of caster wheels 20, such as four caster wheels 20 (with each caster wheel 20 being connected to a separate leg of the chair). Preferably, the caster wheels 20 are configured to allow the chair to be easily rotated 360-degrees by a person sitting on the chair. The invention provides that the caster wheels 20 are secured to the legs of the chair via a caster wheel screw 22 and caster wheel nut 24. According to certain preferred embodiments, the invention provides that the legs of the chair may be adjusted—e.g., increased or decreased in length. In some embodiments, the legs of the chair may include a telescoping mechanism (and locks), which allow a person to extend (lengthen) and compress (shorten) the length of the legs (and subsequently lock the telescoping legs into the desired position). In other embodiments, the legs of the exercise chair may be extended (or shortened) by adding or subtracting joint locks to each of the legs. As shown in FIG. 5, for example, two joint locks—a first joint lock 26 and a second joint lock 28—may be mechanically connected to each other within each chair leg, just above the caster wheels 20, to adjust the length of the legs and therefore the overall height of the exercise chair. Such embodiments allow the height of the exercise chair to be adjusted to accommodate persons of different heights.

Figure 3:
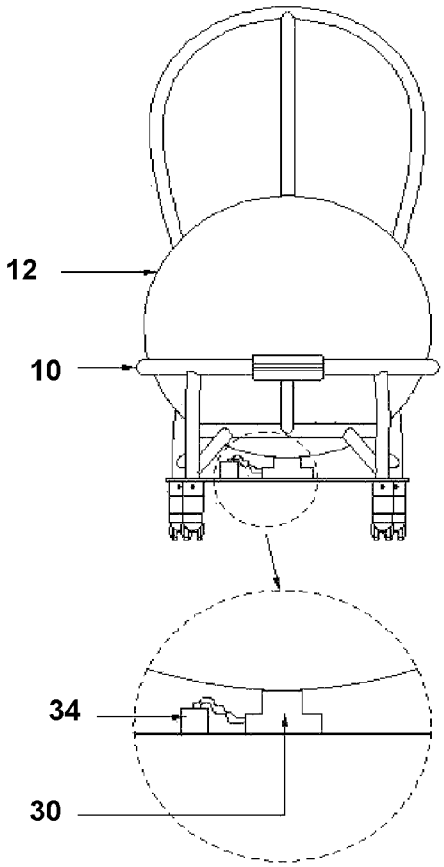
FIG. 3: A front side view of the exercise chair of the present invention, showing an exploded view of the pressure sensor and electronic controller described herein.
Figure 4:
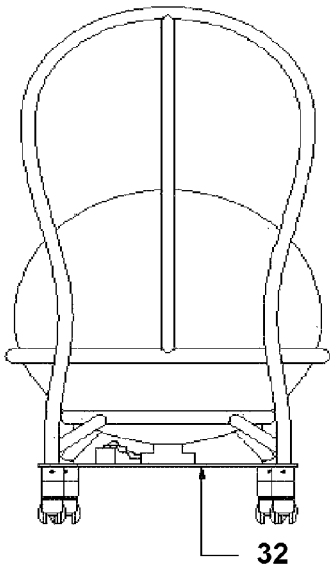
FIG. 4: A back side view of the exercise chair of the present invention.

Referring now to FIGS. 3 and 4, the exercise chair includes certain electrical components that are configured to monitor, record, and communicate an amount of physical activity a person sitting in the chair performs over a defined period of time, and particularly the number of times that such person jumps or hops from the inflated ball 12. Activity of that sort—jumping or hopping up-and-down from the inflated ball 12—exercises a person's leg muscles, stomach muscles, and other core muscles. In addition, such activity will improve a person's blood circulation, relative to the undesirable circulation that results from prolonged and inactive sitting. According to such embodiments, the exercise chair includes a pressure sensor/load cell 30, a support plate/shelf 32 for the pressure sensor 30, an electronic transmitter (controller box) 34, and an LED display 36.

Still referring to FIGS. 3 and 4, the invention provides that the inflated ball 12—when properly inflated—will make (direct or indirect) contact with and be operably connected to the pressure sensor 30, located at the bottom side of the inflated ball 12. More particularly, the pressure sensor 30 may reside adjacent to and make direct contact with the bottom surface of the inflated ball 12, or the pressure sensor 30 may reside adjacent to and make direct contact with a rigid intervening element, which in turn resides adjacent to and makes direct contact with the bottom surface of the inflated ball 12. The pressure sensor 30 is configured to detect when a person is sitting idle on the inflated ball 12 and when a person has just landed from a jumping or hopping motion. That is, when the person is sitting idle, the pressure sensor 30 will detect a baseline amount of pressure or force (exerted by the inflated ball 12 and onto the pressure sensor 30). When a person has landed onto the inflated ball 12 after a jump or a hop, the inflated ball 12 will exert more pressure or force on the pressure sensor 30 (relative to the amount of pressure/force exerted when the person is sitting idle). In such embodiments, the pressure sensor 30 is located on and is supported by a support plate/shelf 32. The invention provides that such pressure measurements (i.e., an amount of force exerted by the inflated ball 12) will be communicated to an operably connected electronic transmitter (controller box) 34.

The invention provides that the electronic transmitter 34 is configured to receive the pressure/force measurements from the pressure sensor 30, and calculate (incrementally over time) whether the detected pressure/force measurements have changed from time (t)=x to time (t)=y, whereby the duration of t=x to t=y may be adjusted as desired, provided that such period of time is sufficiently short to detect whether or not a person has jumped or hopped from the chair during that period of time, e.g., the electronic transmitter 34 may conduct such comparison every 0.1 seconds, 0.5 seconds, 1 second, 2 seconds, 3 seconds, etc. The invention provides that if the pressure/force measurements are different between t=x to t=y, the electronic transmitter 34 will calculate a single jump or hop for the person sitting on the chair. The invention provides that a person's activity—e.g., jumps or hops from the chair—can be detected by the electronic transmitter 34 using other means as well. For example, the pressure sensor 30 may be configured to continuously stream pressure measurements to the electronic transmitter 34, which then detects a jump or hop when the difference between two succeeding pressure measurements exceeds a threshold value (e.g., the pressure measurements could be plotted on a Cartesian graph, with the x plane representing time and the y plane representing pressure/force measurements, whereby each peak in the resulting line graph (caused by a rapid increase in pressure) is calculated as a single jump or hop. The invention provides that the electronic transmitter 34 will include a processor, random access memory, a transmitter, and other electrical components that are necessary to perform the calculations discussed herein, and to communicate the results of such calculations to, for example, the LED display 36 (as mentioned below).

According to certain preferred embodiments, the invention provides that the electronic transmitter 34 is configured to communicate with, and is operably connected to, an LED display 36. The LED display 36 will preferably display the number of jumps or hops calculated by the electronic transmitter 34. The invention provides that the electronic transmitter 34 (or the LED display 36) will preferably include a reset button, which a person may press/activate to cause the number of jumps or hops shown on the LED display 36 to revert to zero. In addition, the invention provides that the electronic transmitter 34 (or the LED display 36) will preferably include a power button, which a person may press/activate to cause the exercise chair to power-on or power-off. The invention further provides that certain components of the exercise chair may exist as separate components, as illustrated in the current Figures, or such components may be combined together. For example, in some embodiments, (1) the pressure sensor 30 and electronic transmitter 34 may be combined into a single unit; (2) the LED display 36 and electronic transmitter 34 may be combined into a single unit; the pressure sensor 30, electronic transmitter 34, and LED display 36 may be combined into a single unit; and so on.

According to certain embodiments, the invention provides that the exercise chair is further configured to detect, and communicate to a user of the chair, when the inflated ball 12 is not sufficiently pressurized/inflated. When the inflated ball 12 is not sufficiently pressurized/inflated, the ability of the pressure sensor 30 to detect each jump or hop by a user would be compromised. For example, according to a basic embodiment, a user of the chair could begin an exercise session and perform a single jump or hop—and, if the pressure sensor 30 and electronic transmitter 34 do not detect and report the jump/hop, the user should assume that the inflated ball 12 is not sufficiently pressurized/inflated, and the user should inject more air into the inflated ball 12 (until the point at which the person's jumps/hops are consistently detected and communicated by the chair).

In certain embodiments, the invention provides that the exercise chair may be configured to communicate wirelessly with a smart device (e.g., smart phone, tablet, smart watch, or other computing device), e.g., using short-wavelength UHF radio waves in the ISM band from 2.4 to 2.485 GHz (Bluetooth® technology). More specifically, the invention provides that the exercise chair, and particularly the electronic transmitter 34 thereof, may include a wireless communication module that is configured to communicate physical activity data (e.g., the number of jumps or hops detected by the electronic transmitter 34 over a period of time) to a smart device. This way, a user of the exercise chair may view his/her activity data within the smart device, in addition to (or in replacement of) the LED display 36. Still further, the invention provides that the smart device may comprise custom software applications, which are configured to receive such activity data and provide a user with additional information related to such activity, e.g., the custom software applications may, using the activity data and other information provided by the user, calculate the number of calories burned by a person resulting from certain activity, it could issue electronic reminders to a person to increase the amount of activity he/she is performing (e.g., the application could advise the user that he/she has been sitting too idle for a period of time), etc.

The invention provides that the exercise chair described herein may be manufactured from various materials. For example, the rigid frame of the chair may be comprised of various types of metals, light-weight aluminum, plastics, wood, and/or other suitable rigid materials. The inflated ball 12 will be comprised of a material that is suitable for inflation (and should exhibit sufficient expandability properties). More particularly, for example, the inflated ball 12 may be comprised of certain polymers, elastomers, rubber materials, vinyl, combinations thereof—e.g. the same or similar types of materials that are commonly used to manufacture standalone inflatable exercise balls. The invention provides that the exercise chair, and particularly the pressure sensor 30, electronic transmitter 34, and LED display 36, may be powered using an internal disposable battery, a rechargeable battery, or through an external powers source (e.g., the chair may include a cord/plug that may be inserted into a conventional power outlet).

The many aspects and benefits of the invention are apparent from the detailed description, and thus, it is intended for the following claims to cover all such aspects and benefits of the invention, which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. An exercise chair, comprising:

(a) a rigid frame that includes an interconnected backrest, four legs, and ball frame;

(b) an inflated ball that is configured to be nestably inserted into the ball frame, wherein a top surface of the inflated ball is configured to receive a sitting person;

(c) a pressure sensor that is positioned beneath and in direct or indirect contact with a bottom surface of the inflated ball, wherein the pressure sensor is configured to (i) detect pressure exerted by the inflated ball on the pressure sensor and (ii) calculate force measurements resulting from the pressure exerted by the inflated ball; and (d) an electronic transmitter that is configured to (i) receive the force measurements from the pressure sensor; (ii) calculate whether a person sitting on the chair jumped from the chair based on said force measurements during a defined period of time; and (iii) communicate a total number of calculated jumps by the person over a defined period of time to the person.

2. The exercise chair of claim 1, which further comprises a light-emitting diode (LED) display that is operably connected to, and configured to receive data from, the electronic transmitter, wherein the LED display is further configured to visually communicate the total number of calculated jumps by the person over a defined period of time.

3. The exercise chair of claim 2, which further comprises a wireless communication module that is configured to communicate the total number of calculated jumps by the person over a defined period of time, wirelessly to a smart device using short-wavelength ultra-high frequency (UHF) radio waves.

4. The exercise chair of claim 3, wherein each of the four legs is adjustable and configured to be increased or decreased in length.

5. The exercise chair of claim 4, wherein each of the four legs comprises a caster wheel.

6. The exercise chair of claim 5, wherein each of the four legs is adjustable and configured to be increased or decreased in length, by adding or removing one or more joint locks between a bottom end of each leg and the caster wheel.

7. The exercise chair of claim 6, wherein the ball frame includes a first frame component and a second frame component, wherein:

(a) the first frame component and second frame component each exhibit a circular configuration;

(b) the first frame component is larger in diameter than the second frame component;

(c) the first frame component exhibits a diameter that is configured to securely hold the inflated ball at, or just below, a mid-way point of the inflated ball; and (d) the second frame component is configured to securely hold and support the inflated ball near a bottom area of the inflated ball.

8. The exercise chair of claim 1, which further includes a support shelf that holds and positions the pressure sensor beneath the inflated ball.

9. An exercise system, which comprises an exercise chair, a smart device, and a software application housed within the smart device, wherein the exercise chair comprises:

(a) a rigid frame that includes an interconnected backrest, four legs, and ball frame;

(b) an inflated ball that is configured to be nestably inserted into the ball frame, wherein a top surface of the inflated ball is configured to receive a sitting person;

(c) a pressure sensor that is positioned beneath and in direct or indirect contact with a bottom surface of the inflated ball, wherein the pressure sensor is configured to (i) detect pressure exerted by the inflated ball on the pressure sensor and (ii) calculate force measurements resulting from the pressure exerted by the inflated ball; and (d) an electronic transmitter that is configured to (i) receive the force measurements from the pressure sensor; (ii) calculate whether a person sitting on the chair jumped from the chair based on said force measurements during a defined period of time; and (iii) communicate a total number of calculated jumps by the person over a defined period of time to the smart device via a wireless communication module.

10. The exercise system of claim 9, wherein the wireless communication module is configured to communicate the total number of calculated jumps by the person over a defined period of time, wirelessly to the smart device using short-wavelength ultra-high frequency (UHF) radio waves.

11. The exercise system of claim 10, wherein the software application is configured to perform, and display within the smart device results of, additional calculations based on the force measurements.

12. The exercise system of claim 11, wherein each of the four legs is adjustable and configured to be increased or decreased in length.

13. The exercise system of claim 12, wherein each of the four legs comprises a caster wheel.

14. The exercise system of claim 13, wherein each of the four legs is adjustable and configured to be increased or decreased in length, by adding or removing one or more joint locks between a bottom end of each leg and the caster wheel.

15. The exercise system of claim 14, wherein the ball frame includes a first frame component and a second frame component, wherein:

(a) the first frame component and second frame component each exhibit a circular configuration;

(b) the first frame component is larger in diameter than the second frame component;

(c) the first frame component exhibits a diameter that is configured to securely hold the inflated ball at, or just below, a mid-way point of the inflated ball; and (d) the second frame component is configured to securely hold and support the inflated ball near a bottom area of the inflated ball.

16. The exercise system of claim 9, which further includes a support shelf that holds and positions the pressure sensor beneath the inflated ball.

* * * * *